US009282823B2

(12) United States Patent
Kumazawa

(10) Patent No.: US 9,282,823 B2
(45) Date of Patent: Mar. 15, 2016

(54) LINKING MECHANISM AND CHAIR

(75) Inventor: Taku Kumazawa, Nagoya (JP)

(73) Assignee: Aichi Co., Ltd., Nagoya-shi, Aichi (JP)

( * ) Notice: Subject to any disclaimer, the term of this patent is extended or adjusted under 35 U.S.C. 154(b) by 847 days.

(21) Appl. No.: 13/393,168

(22) PCT Filed: Oct. 12, 2011

(86) PCT No.: PCT/JP2011/073422
§ 371 (c)(1),
(2), (4) Date: Feb. 28, 2012

(87) PCT Pub. No.: WO2012/153435
PCT Pub. Date: Nov. 15, 2012

(65) Prior Publication Data

US 2012/0286551 A1 Nov. 15, 2012

(30) Foreign Application Priority Data

May 10, 2011 (JP) ..... 2011-105340

(51) Int. Cl.
*A47C 15/00* (2006.01)
*A47C 1/124* (2006.01)

(52) U.S. Cl.
CPC ..... *A47C 1/124* (2013.01)

(58) Field of Classification Search
CPC ..... A47C 1/124; A47C 3/00
USPC ..... 297/249, 248, 447.4
See application file for complete search history.

(56) References Cited

U.S. PATENT DOCUMENTS 2,956,618 A * 10/1960 Eames et al. ..... 297/248
3,614,157 A * 10/1971 Hendrickson et al. ..... 297/248
3,620,567 A * 11/1971 Hendrickson et al. ..... 297/463.1
3,695,694 A * 10/1972 Mohr ..... 297/248
3,697,130 A * 10/1972 Barecki et al. ..... 297/248
4,351,390 A 9/1982 Argyle et al.
4,386,804 A * 6/1983 Ware ..... A47C 1/124 108/64
5,282,669 A * 2/1994 Barile ..... 297/248

(Continued)

FOREIGN PATENT DOCUMENTS

DE 41 35 602 A1 5/1992
JP 56-127807 A 10/1981

(Continued)

OTHER PUBLICATIONS

Notification of Transmittal of Translation of the International Preliminary Report on Patentability (Form PCT/IB/338) corresponding to International Patent Application No. PCT/JP2011/073422 dated Nov. 21, 2013.

(Continued)

*Primary Examiner* — David R Dunn
*Assistant Examiner* — Alexander Harrison
(74) *Attorney, Agent, or Firm* — Jenkins, Wilson, Taylor & Hunt, P.A.

(57) ABSTRACT

A linking mechanism includes a convex linking member and a concave linking member, which are provided to each of the chairs aligned in a left and right direction. Each of the linking members is engaged with each other so that linkage of the neighboring chairs is realized. The convex linking member includes a convex-side mounting portion, an extending portion, a notch portion, and an engaging piece. The concave linking member includes a concave-side mounting portion, an engaging projection, and a pair of engaging wall portions.

19 Claims, 14 Drawing Sheets

(56) References Cited

U.S. PATENT DOCUMENTS

| | | | | |
|---|---|---|---|---|
| 5,511,851 | A * | 4/1996 | Zivari | 297/249 |
| 5,957,530 | A * | 9/1999 | Gutgsell | 297/248 |
| 6,338,528 | B1 * | 1/2002 | Lohness et al. | 297/248 |
| 6,866,338 | B2 * | 3/2005 | Mendenhall et al. | 297/239 |
| 2005/0012371 | A1 * | 1/2005 | Mendenhall et al. | 297/248 |
| 2010/0176634 | A1 * | 7/2010 | Wahl et al. | 297/248 |
| 2012/0313412 | A1 * | 12/2012 | Fahlstedt | 297/248 |
| 2014/0175848 | A1 * | 6/2014 | Motta | 297/248 |

FOREIGN PATENT DOCUMENTS

| | | | |
|---|---|---|---|
| JP | 57-047956 | U | 3/1982 |
| JP | 9-220132 | A | 8/1997 |
| JP | H09-215546 | A | 8/1997 |
| JP | 2000-320511 | A | 11/2000 |
| JP | 2002-223888 | A | 8/2002 |

OTHER PUBLICATIONS

International Preliminary Report on Patentability—Chapter I of Patent Cooperation Treaty (Form PCT/IB/373) corresponding to International Patent Application No. PCT/JP2011/073422 dated Nov. 12, 2013 (including English Translation of Written Opinion of the International Searching Authority (Form PCT/ISA/237)).

International Search Report for International Patent Application No. PCT/JP2011/073422 issued on Nov. 11, 2011.

Japanese Office Action for Application No. 2011/548486 dated Aug. 25, 2015.

* cited by examiner

LINKING MECHANISM AND CHAIR

CROSS-REFERENCE TO RELATED APPLICATIONS

This application is filed under the provisions of 35 U.S.C. 371 and claims priority of international application no. PCT/JP2011/073422 filed on Oct. 12, 2011, which in turn claims priority of Japanese Patent Application No. 2011-105340 filed on May 10, 2011. The disclosures of the foregoing international patent application and Japanese patent application are hereby incorporated by reference herein in their respective entireties.

TECHNICAL FIELD

The present invention relates to a linking mechanism which realizes linkage of each of the chairs aligned in the left and right direction.

BACKGROUND ART

Conventionally, a linking mechanism, which links each of the neighboring chairs to maintain that a plurality of chairs are aligned in the left; and right direction, has been used.

This kind of linking mechanism includes a linking member which is provided to one of the neighboring chairs and which has an extending portion that concavely extends, and a linking member which is provided to the other of the neighboring chairs and which has a concave space into which the extending portion engages. The linking mechanism is generally configured so that these linking members are engaged with each other to realize linkage of each of the chairs (see Patent Document 1).

PRIOR ART DOCUMENTS

Patent Document

Patent Document 1: Japanese Unexamined Patent Application Publication No. 9-220132 (particularly see FIGS. 1, 2 and 6)

SUMMARY OF THE INVENTION

Problems to be Solved by the Invention

In the above linking mechanism, the extending portion formed in a convex shape in one of the linking members has a projection which projects along the front and back direction of a chair. Also, the concave space in the other of the linking members is formed such that region corresponding to the projection of the extending portion is widened in the front and back direction. Accordingly, one of the linking members is inhibited from being displaced in the front, hack, left and right directions with respect to the other of the linking members by the engagement of the projection into the space.

However, each of the chairs aligned in the left and right direction is often subjected to a force that causes the front or back end side of the chair to be displaced in the up and down direction, as well as a force that causes the chair to be displaced in the front, back, left and right directions, when, for example, a user stands up or sits down, or passes through a space in front of or behind the chair thereby to contact the chair.

In this case, the chair makes a rotational motion about the (back or front) end side opposite to the (front or back) end side contacted by the user. At this time, there is a problem in the above linking mechanism that the extending portion is displaced in the rotational direction together with the projection within the space, thereby easily disengaging the linkage of each of the linking members.

This is because, in the above linking mechanism, with respect to the displacement in the rotational direction, the convex extending portion in one of the linking members contacts only the front and back ends of the inner circumference surface of the concave space in the other of the linking members, thereby disenabling satisfactory control of the displacement in the rotational direction.

It is desirable to provide a linking mechanism in which the linkage of each of the linking members is more difficult to be disengaged and which is more suitable for maintaining a state in which the neighboring chairs are aligned, as compared to the conventional linking mechanism.

Means for Solving the Problems

To solve the above problems, the first structure is a linking mechanism which includes a convex linking member and a concave linking member. The convex and concave linking members are provided to each of the chairs aligned in a left and right direction, to realize linkage of each of the chairs by engaging each of the members.

The convex linking member includes a convex-side mounting portion which is provided in one of the left and right side regions in a chair on one hand; an extending portion which extends in a direction from the convex-side mounting portion toward a chair on the other hand; a notch portion which divides the extending portion into two parts in the front and back direction by notching a region reaching from the front end region of the extending portion to the convex-side mounting portion side; and an engaging piece which projects along the front and back direction from one or both of the front end sides of the two parts into which the extending portion is divided by the notch portion.

The concave linking member includes a concave-side mounting portion which is provided, to the other of the left and right side regions in the chair on the other hand; an engaging projection which projects in a direction from the concave-side mounting portion toward the chair on one hand to engage with the notch portion in the convex linking member; and a pair of engaging wall portions between which the engaging projection is located. Each of the engaging wall portions surrounds, for engagement, one of the two parts into which the extending portion is divided and the engaging piece in the surrounded part of the extending portion in the convex linking member.

In the linking mechanism according to this structure, not only the extending portion (and the engaging piece) the convex linking member engages into the spaces surrounded by the engaging wall portions in the concave linking member, but also the engaging projection in the concave linking member engages into the notch portion formed in the extending portion of the convex linking member. Thus, the engaging projection of the concave linking member is located between the two parts of the extending portion in the convex linking member in the front and back direction.

According to this structure, the extending portion in the convex linking member becomes difficult to be displaced along the rotational direction within the spaces surrounded by the engaging wall portions in the concave linking member, even if a chair is subjected to a force that causes the front or back end side of the chair to be displaced in the up and down direction thereby to make a rotational motion about the end side opposite to the end side subjected to such a force, when, for example, a user stands up or sits down, or passes through the space in front of or behind the chair thereby to contact the chair.

This is because, in the above structure, with respect to the displacement in the rotational direction, not only the extending portion (and the engaging piece) of the convex linking member and the inner circumference surfaces of the engaging wall portions in the concave linking member contact each other in the regions of the front and back ends, but also the inner circumference surface of the notch portion in the convex linking member and the engaging projection in the concave linking member contact each other in the regions of the front and hack ends. Thus, since larger frictional resistance can be ensured due to the contact area larger than the conventional structure, the extending portion in the convex linking member is inhibited from being displaced along the rotational direction.

As a result, since the engagement of each of the linking members becomes difficult to be disengaged, a linking mechanism suitable for maintaining a state in which the neighboring chairs are aligned can be realized. According to the above structure, regarding the extending portion (and the engaging piece) of the convex linking member and the engaging wall portions of the concave linking member, as long as the former is engaged into the spaces surrounded by the latter, a concrete extending direction or the like thereof is not specifically limited.

For example, in a case where the engaging piece in the convex linking member projects along the front and back direction from each of the end sides of the two parts into which the extending portion is divided by the notch portion, it is conceivable that the above structure may be configured as the second structure described below.

In the second structure, the pair of engaging wall portions in the concave linking member, between which the engaging projection is located, includes a site which extends from the concave-side mounting portion toward the chair on one hand and a site which extends along the front or back direction. Each of the engaging wall portions may be a wall, which surrounds, for engagement, the extending portion and the engaging piece in the surrounded extending portion in the convex linking member, between the concave-side mounting portion and the engaging projection.

According to this structure, the extending portion and the engaging pieces of the convex linking member are surrounded for engagement by the engaging wall portions which extend in the direction from the concave-side mounting portion to the chair on one hand and along the front or back direction.

As a more concrete example, it is conceivable that the above structure may be configured as the third structure described below.

In the third structure, the engaging pieces in the convex linking member project from the end sides of the extending portion, toward the direction away from each other respectively. Also, the pair of engaging wall portions in the concave linking member, between which the engaging projection is located, may extend in the direction from the concave-side mounting portion toward the chair on one hand and in the direction toward the engaging projection.

According to this structure, the engaging pieces, which project in the direction away from each other in the convex linking member, can be engaged into the spaces surrounded by the engaging wall portions which extend in the direction toward the engaging projection in the concave linking member respectively.

Also, in a linking mechanism, clearance (a gap) is designed in consideration of workability (easiness of attaching and detaching) when linking. The clearance is normally ensured between the extending portion and the engaging pieces) in the convex linking member and the spaces surrounded by the engaging wall portions in the concave linking member. Therefore, there is a possibility that the extending portion (and the engaging pieces) of the convex linking member and the engaging wall portions of the concave linking member are not satisfactorily contacted to each other.

Therefore, if the extending portion and the engaging pieces of the convex linking member and the engaging wall portions of the concave linking member can be satisfactorily contacted, frictional resistance is also increased. Therefore, the displacement along the rotational direction described above is more easily inhibited.

Thus, in order to obtain satisfactory contact between the extending portion and the engaging pieces of the convex linking member and the engaging wall portions of the concave linking member, each of the above structures may be configured as the fourth structure described below.

In the fourth structure, the width in the front and back direction of an end side opposite to a front end of the engaging projection the concave linking member may be relatively larger than that of the region of the notch portion with which the opposite end side engages.

According to the structure described above, when the engaging projection of the concave linking member is engaged into the notch portion of the convex linking member, the notch portion is pushed to be widened by the engaging projection. Accordingly, each of the two parts into which the extending portion is divided is pushed against each of the inner circumference surfaces of the engaging wall portions in the concave linking member, while coming into intimate contact with the engaging projection. Therefore, the extending portion and the engaging pieces of the convex linking member and the engaging wall portions of the concave linking member can satisfactorily contact each other in the regions of the front and back ends, while ensuring workability of engaging and disengaging.

As a more concrete structure, this structure may be configured, for example, as the fifth and sixth structures described below.

First, in the fifth structure, the notch portion in the convex linking member may notch the region thereof so that the width in the front and back direction in a front end region of the extending portion is smaller than that in a region of the convex-side mounting portion side.

In this structure, since the notch portion of the convex linking member is narrow in the front end region of the extending portion, when the engaging projection of the concave linking member engages into the notch portion, the notch portion is pushed to be widened by the engaging projection. Accordingly, each of the two parts into which the extending portion is divided is pushed against each of the inner circumference surfaces of the engaging wall portions in the concave linking member, while coming into intimate contact with the engaging projection. Thus, the extending portion and the engaging pieces of the convex linking member and the engaging wall portions of the concave linking member can satisfactorily contact each other in the regions of the front and back ends.

Also, in the sixth structure, the width in the front and back direction on the end side opposite to the front end of the engaging projection in the concave linking member may be formed so as to be larger than that on the front end side thereof.

In this structure, since the width of the engaging projection in the concave linking member is larger on the end side opposite to the front end than the front end, when the engaging projection is engaged into the notch portion of the convex linking member, the notch portion is pushed to be widened. Accordingly, each of the two parts into which the extending portion is divided is pushed against each of the inner circumference surfaces of the engaging wall portions in the concave linking member, while coming into intimate contact with the engaging projection. Thus, the extending portion and the engaging pieces of the convex linking member and the engaging wall portions of the concave linking member can satisfactorily contact each other in the regions of the front and back ends.

Also, each of the above structures may be configured as the seventh structure described below.

In the seventh structure, the convex linking member may include at least a front-side convex linking member and a back-side convex linking member. The front-side convex linking member realizes linkage with the chair on the other hand on the front side of the chair, and the back-side convex linking member realizes linkage with the chair on the other hand on the back side of the chair. The concave linking member may include at least a front-side concave linking member and a back-side concave linking member. The front-side concave linking member realizes linkage with the chair on one hand on the front side of the chair, and the back-side concave linking member realizes linkage with the chair on one hand on the back side of the chair.

In this case, a connecting member, which connects the front-side convex linking member and the back-side convex linking member and/or connects the front-side concave linking member and the back-side concave linking member, may be provided between the front-side convex linking member and the back-side convex linking member, and/or between the front-side concave linking member and the hack-side concave linking member.

According to this structure, since a distance between the front side and the back side can be uniquely determined by the connecting member, positioning can be adjusted more easily during the work of mounting the linking member to the chair.

Also, each of the above structures may be configured as the eighth structure described below.

In the eighth structure, the convex-side mounting portion in the convex linking member may include a notch portion projection which projects in a direction from the region where the notch portion is formed toward the chair on the other hand. The engaging projection in the concave linking member may include a projection portion notch which notches the engaging projection from the front end toward the concave-side mounting portion and with which the notch portion projection in the convex linking member engages.

According to this structure, with respect to the above-mentioned displacement in the rotational direction, the extending portion of the convex linking member and the inner circumference surfaces of the engaging wall portions in the concave linking member, and the inner circumference surface of the notch portion in the convex linking member and the engaging projection of the concave linking member contact each other respectively in the regions of the front and hack ends. In addition, the notch portion projection of the convex linking member and the projection portion notch of the concave linking member contact each other in the regions of the front and back ends. Accordingly, with respect to the displacement in the rotational direction, displacement of each, of the linking members can be effectively inhibited.

Also, in each of the above structures, the ninth structure described below may be applied.

In the ninth structure, a convex-side extension member as described below may be provided so as to be removably fixed to the convex linking member. In this case, the convex-side extension member may include a convex-side fixing portion which is removably fixed to the convex linking member; a convex-side extension portion which is formed by extending the convex-side fixing portion to the end in the direction toward the chair on the other hand; an extension extending portion which extends from the end region in the direction toward the chair on the other hand of the convex-side extension portion, to the direction toward the chair on the other hand; an extension notch portion which divides the extension extending portion into two parts in the front and back direction by notching the region reaching from a front end region of the extension extending portion to the convex-side extension portion side and which is formed as a notch capable of engaging with the engaging projection of the concave linking member; and an extension engaging piece which projects along the front and back direction from one or both of the frond end sides of the two parts into which the extension extending portion is divided by the extension notch portion and which is formed as an engaging piece to be surrounded by the engaging wall portion of the concave linking member, together with the extension extending portion, for engagement.

According to this structure, when the convex-side extension member is fixed to the convex linking member, the extension extending portion, the extension notch portion and the extension engaging piece in the convex-side extension member function as the extending portion, the notch portion and the engaging piece in the convex linking member. Therefore, even in this state, linkage with the concave linking member can be realized.

Here, since the convex-side extension member to be fixed to the convex linking member is formed by further extending the convex linking member toward the chair on the other hand, the distance between the neighboring chairs can be adjusted in accordance with an extended length of the convex-side extension portion, depending on whether the convex-side extension member is fixed to or removed from the convex linking member.

Also, although a structure for fixing the convex-side extension member to the convex linking member is not specifically limited, the structure may utilize the shape of the convex linking member. For example, it is conceivable that such a structure is realized by the tenth structure described below.

In the tenth structure, the convex-side fixing portion in the convex-side extension member has sites which function as the engaging projection and the pair of engaging wall portions in the concave linking member. It may be configured that the convex-side extension member and the convex linking member are fixed to each other by engaging each of the sites with each of the extending portion, the notch portion, and the engaging piece in the convex linking member.

According to this structure, fixing of the convex-side extension member and the convex linking member can be realized by engaging each of the sites in the convex-side fixing portion which functions as each of the concave-side mounting portion, the engaging projection and the pair of engaging wall portions in the concave linking member, with each of the extending portion, the notch portion and the engaging piece in the convex linking member.

Also, as a structure for realizing fixing of the convex-side extension member and the convex linking member, it is conceivable that fixing of the both is realized by screwing or the like. For this purpose, the above structure may be configured as the eleventh structure described below.

In the eleventh structure, the convex-side fixing portion in the convex-side extension member may be secured to the extending portion in the convex linking member so that the convex-side extension member and the convex linking member are fixed.

According to this structure, fixing of the convex-side extension member and the convex linking member can be realized by screwing the convex-side fixing portion to the extending portion in the convex linking member.

Also, it is conceivable that the convex-side extension member and the convex linking member can be attached and detached by displacing the convex-side extension member when the both are linked. For this purpose, the above structure may be configured as the twelfth structure described below.

In the twelfth structure, in the convex-side extension member, the convex-side fixing portion may include a rotational mounting portion and a surrounding positioning portion. The rotational mounting portion is mounted to the convex linking member in a position where the convex-side extension member as a whole rotates about an axis extending in the front and back direction. The surrounding positioning portion surrounds the extending portion and the engaging piece to position the convex-side extension member when the extending direction of the convex-side extension portion runs along the direction toward the chair on the other hand.

According to this structure, a state in which the convex-side extension member is engaged with the convex linking member can be realized by rotating the convex-side extension member about the rotational mounting portion in the convex-side fixing portion so that the extending direction of the convex-side extension portion runs along the direction toward the chair on the other hand. Furthermore, a state in which the convex-side extension member is removed from the convex linking member can be realized by rotating the convex-side extension member so that the extending direction of the convex-side extension portion runs along the up and down direction.

Also, in each of the above structures, the thirteenth structure described below may be applied.

In the thirteenth structure, a concave-side extension member as described below may be provided so as to be removably fixed to the concave linking member. In this case, the concave-side extension member may include a concave-side fixing portion which is removably fixed to the concave linking member; a concave-side extension portion which is formed by extending the concave-side fixing portion in the direction toward the chair on one hand; an extension engaging projection which projects in the direction from the concave-side extension portion toward the chair on one hand to engage into the notch portion in the convex linking member; and a pair of extension engaging wall portions between which the extension engaging projection is located. Each of the extension engaging wall portions becomes a wall which surrounds, for engagement, one of the two parts into which the extending portion is divided and the engaging piece in the surrounded part of the extending portion in the convex linking member.

According to this structure, when the concave-side extension member is fixed to the concave linking member, the extension engaging projection and the pair of extension engaging wall portions in the concave-side extension member function as the engaging projection and the pair of engaging wall portions in the concave linking member. Therefore, even in this state, linkage with the convex linking member can be realized.

Here, since the concave-side extension member which is fixed to the concave linking member is formed by further extending the concave linking member toward the chair on one hand, a distance between the neighboring chairs can be adjusted in accordance with the extended length of the concave-side extension portion, depending on whether the concave-side extension member is fixed to or removed from the concave linking member.

Also, although a structure for fixing the concave-side extension member and the concave linking member is not specifically limited, the structure may utilize the shape of the concave linking member. For example, it is conceivable that such a structure is realized by the fourteenth structure described below.

In the fourteenth structure, in the concave-side extension member, the concave-side fixing portion has sites which function as the extending portion, the notch portion and the engaging portion in the convex linking member. It may be configured that the concave-side extension member and the concave linking member are fixed by engaging each of the sites with each of the engaging projection and the pair of engaging wall portions in the concave linking member.

According to this structure, fixing of the concave-side extension member and the concave linking member can be realized, by engaging the sites in the concave-side fixing portion which function as the extending portion, the notch portion and the engaging portion in the convex linking members, with the engaging projection and the pair of engaging wall portions in the concave linking member respectively.

Also, as a structure for realizing fixing of the concave-side extension member and the concave linking member, it is conceivable that fixing of the both is realized by screwing or the like. For this purpose, the above structure may be configured as the fifteenth structure described below.

In the fifteenth structure, in the concave-side extension member, the concave-side fixing portion may be screwed to the engaging projection or the engaging wall portions in the concave linking member so that the concave-side extension member and the concave linking member are fixed.

According to this structure, fixing of the concave-side extension member and the concave linking member can be realized by screwing the concave-side fixing portion to the engaging projection or the engaging wall portions in the concave linking member.

Also, it is conceivable that the concave-side extension member and the concave linking member are attached and detached by displacing the concave-side extension member when the both are linked. For this purpose, the above structure may be configured as the sixteenth structure described below.

In the sixteenth structure, in the concave-side extension member, the concave-side fixing portion may include a rotational mounting portion and a surrounding positioning portion. The rotational mounting portion is mounted to the concave linking member in a position where the concave-side extension member as a whole rotates about an axis extending in the front and back direction. The surrounding positioning portion surrounds the engaging wall portions to position the concave-side extension member when the extending direction of the concave-side extension portion runs along the direction toward the chair on one hand.

According to this structure, a state in which the concave-side extension member is mounted to the concave linking member can be realized, by rotating the concave-side extension member about the rotational mounting portion in the concave-side fixing portion so that the extending direction of the concave-side extension portion runs along the direction toward the chair on one hand. Furthermore, a state in which the concave-side extension member is removed from the concave linking member can be realized by rotating the concave-side extension member so that the extending direction of the concave-side extension portion runs along the up and down direction.

Also, to solve the above problems, a chair according to the seventeenth structure may be the chair provided with a linking member, which includes a convex linking member and a concave linking member.

The convex linking member is a convex linking member according to one of the first to sixteenth structures, and the concave linking member is a concave linking member according to one of the first to sixteenth structures.

The chair according to this structure can achieve operation and effect similar to each of the above structures, by the linking member including the convex linking member and the concave linking member.

EXPLANATION OF REFERENTIAL NUMERALS

1 . . . linking mechanism, 10 . . . convex linking member, 11 . . . convex-side mounting portion, 13 . . . extending portion, 15 . . . notch portion, 17 . . . engaging piece, 19 . . . leg body support portion, 20 . . . concave linking member, 21 . . . concave-side mounting portion, 23 . . . engaging projection, 25 . . . space, 27 . . . engaging wall portion, 29 . . . leg body support portion, 30 . . . convex-side extension member, 31 . . . convex-side fixing portion, 32 . . . convex-side extension portion, 33 . . . extension extending portion, 35 . . . extension notch portion, 37 . . . extension engaging piece, 41, 43 . . . site, 45 . . . screw or the like, 47 . . . rotational mounting portion, 49 . . . surrounding positioning portion, 50 . . . concave-side extension member, 51 . . . concave-side fixing portion, 52 . . . concave-side extension portion, 53 . . . extension engaging projection, 57 . . . extension engaging wall portion, 61, 63 . . . site, 65 . . . screw or the like, 71 . . . plate-like portion, 73 . . . rotational mounting portion, surrounding positioning portion, 81, 82 . . . connecting member, 91 . . . notch portion projection, 93 . . . projection portion notch, 100 . . . chair, 110 . . . right leg body, 120 . . . left leg body, 130 . . . seat body, 140 . . . armrest

MODE FOR CARRYING OUT THE INVENTION

Embodiments of the present invention will be explained below with reference to the drawings.

(1) First Embodiment (1-1) Entire Structure

Figure 1:
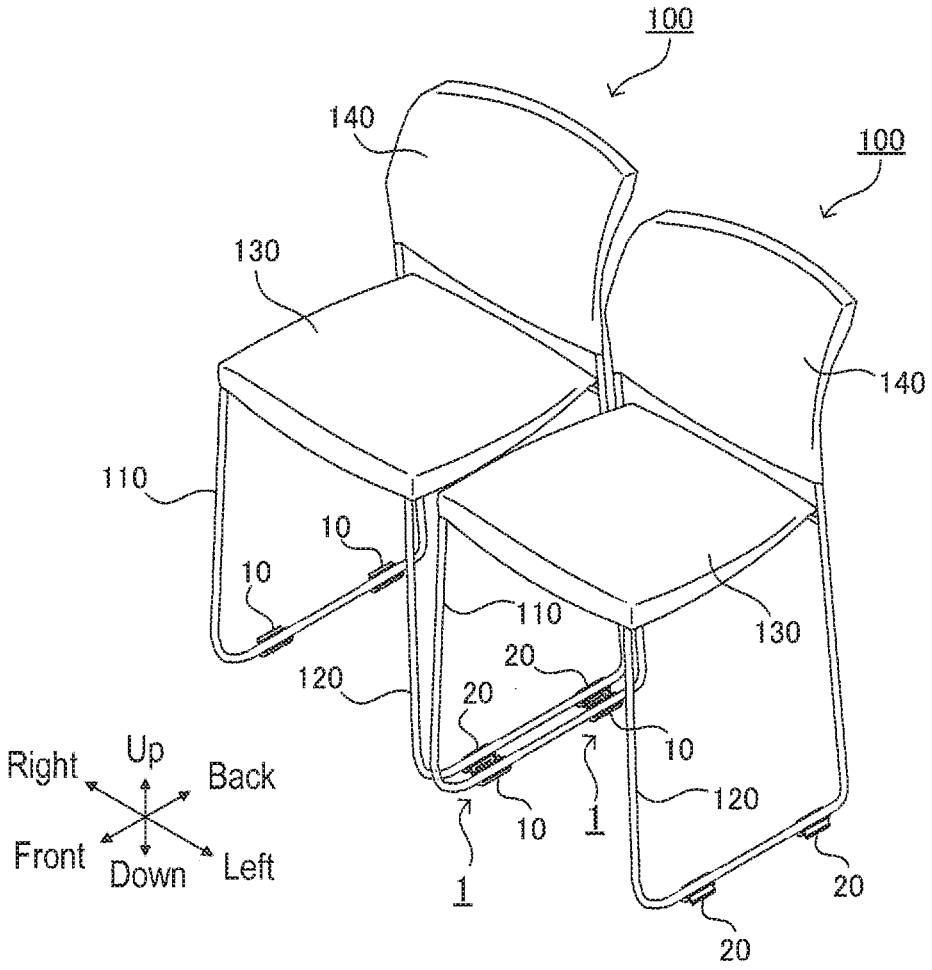
FIG. 1 is a perspective view showing chairs linked with the linking mechanism.

A linking mechanism 1 includes, as shown in FIG. 1, a convex linking member 10 and a concave linking member 20 which are provided on each of chairs 100 aligned in the left and right direction. By engaging the convex linking member 10 and the concave linking member 20, linkage of each of the chairs 100 is realized.

Each chair 100 according to the present embodiment includes a right leg body 110, a left leg body 120, a seat body 130 supported by the right leg body 110 and the left leg body 120, a backrest 140 and the like. The convex linking member 10 is provided at two locations in the front and hack direction in one of the left and right side regions of each chair 100, and the concave linking member 20 is provided at two locations in the front and back direction in the other of the left and right side regions of each chair 100. In the present embodiment, the convex linking member 10 is provided below the right leg body 110, that is the right side region, and the concave linking member 20 is provided below the left leg body 120, that is the left side region.

Figure 2:
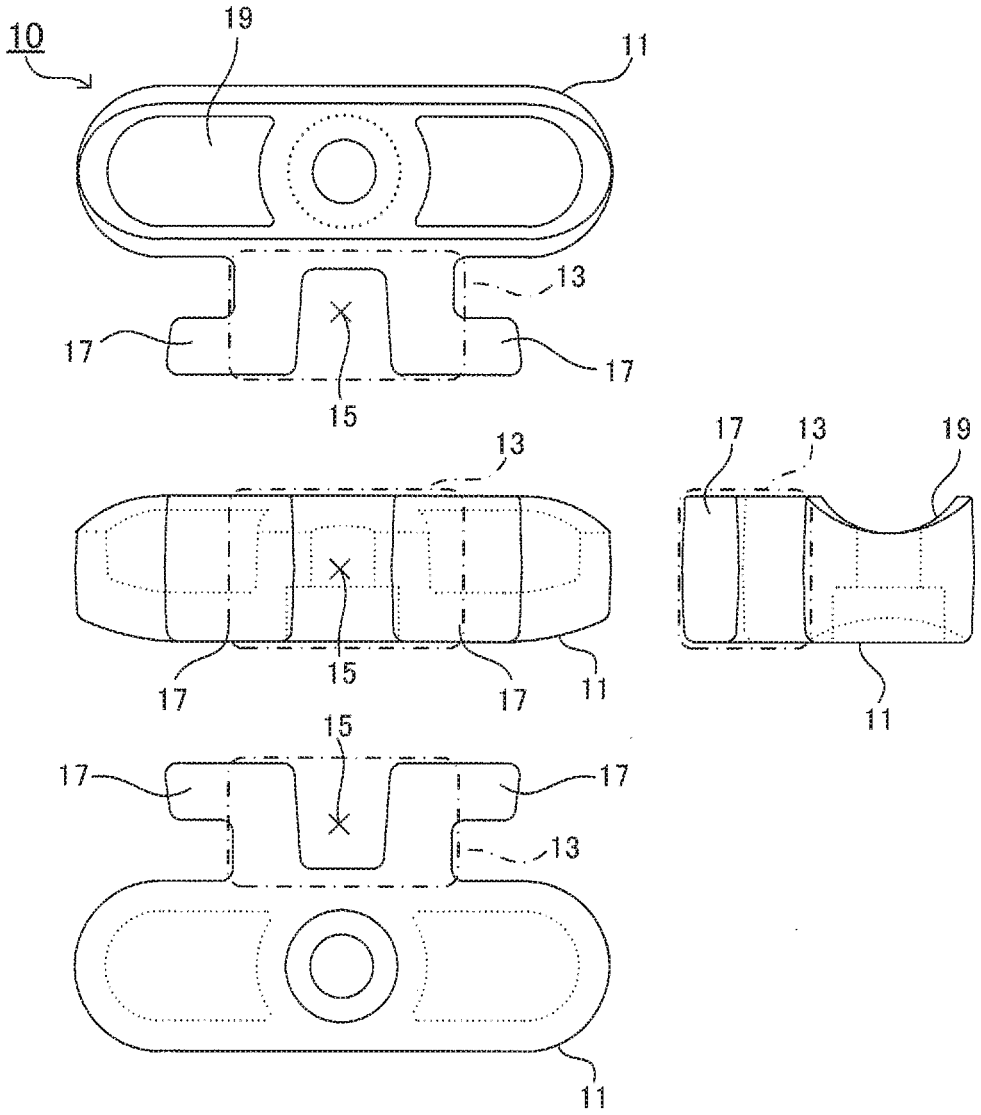
FIG. 2 is a four-view drawing showing the convex linking member according to the first embodiment.

The convex linking member 10 includes, as shown in FIG. 2, a convex-side mounting portion 11 which is provided to one of left and right side regions in a chair 100 on one hand; an extending portion 13 which extends in a direction from the convex-side mounting portion 11 toward a chair 100 on the other hand (in the direction away from the convex-side mounting portion 11); a notch portion 15 which is formed by notching the region reaching from a front end region of the extending portion 13 to a side of the convex-side mounting portion 11; a pair of engaging pieces 17 which project along the front and back direction from the front end sides of two parts into which the extending portion 13 is divided by the notch portion 15 respectively; and a concave-shaped leg body support portion 19 which is provided on the convex-side mounting portion 11 to support the right leg body 110 in the chair 100.

The pair of engaging pieces 17 according to the present embodiment are configured to project from the front end sides of the extending portion 13 toward the direction away from each other (forward and backward respectively). The notch portion 15 notches the extending portion 13 thereby to divide the extending portion 13 into two parts in the front and back direction of the chair 100 (in the longitudinal direction of the convex-side mounting portion 11). Furthermore, the extending portion 13 is notched such that the width in the front and back direction in the region on the front end side of the extending portion 13 is larger than that in the region on the convex-side mounting portion 11 side.

Figure 3:
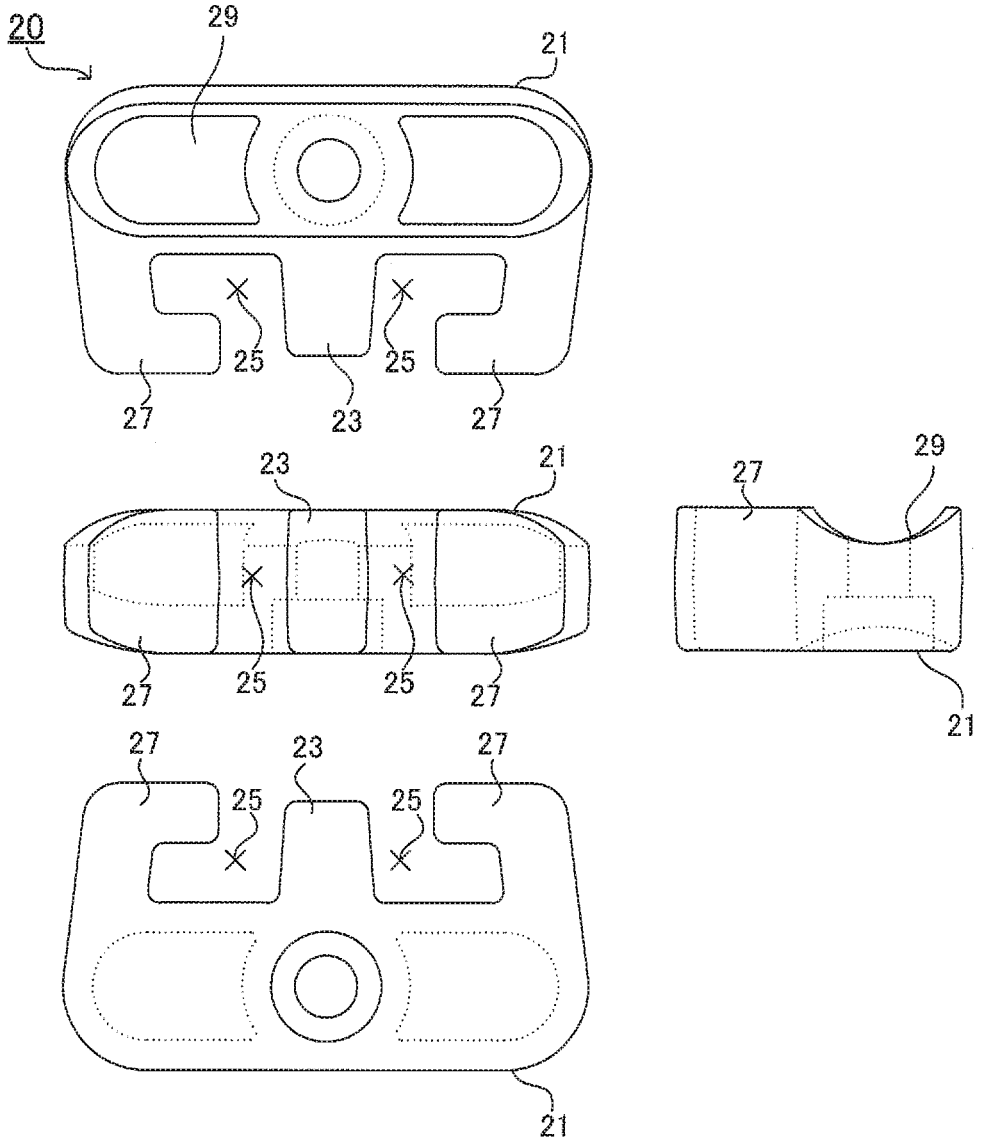
FIG. 3 is a four-view drawing showing the concave linking member according to the first embodiment.

The concave linking member 20 includes, as shown in FIG. 3, a concave-side mounting portion 21 which is provided on the other of the left and right side regions in the chair 100 on the other hand; an engaging projection 23 which projects in the direction from the concave-side mounting portion 21 toward the chair 100 on one hand (in the direction away from the concave-side mounting portion 21); a pair of engaging wall portions 27 between which the engaging projection 23 is located and which extend along the direction from the concave-side mounting portion 21 toward the chair 100 on one hand (same as above) and along the direction toward one of the back and forth directions (the longitudinal direction of the concave-side mounting portion 21); and a leg body support portion 29 which supports the left leg body 120 in the chair 100.

The pair of engaging wall portions 27 according to the present embodiment extend in the direction away from the concave-side mounting portion 21, and then in the direction toward the engaging projection 23 respectively. Accordingly, spaces 25 are formed between the concave-side mounting portion 21 and the engaging projection 23. Furthermore, the engaging projection 23 is formed such that the width in the front and back direction on the end side (i.e., the base) opposite to the front end side is larger than that on the front end side. The width in the front and, back direction of the base side of the engaging projection 23 is larger than that in the region of the notch portion 15 with which the base side engages.

Figure 4:
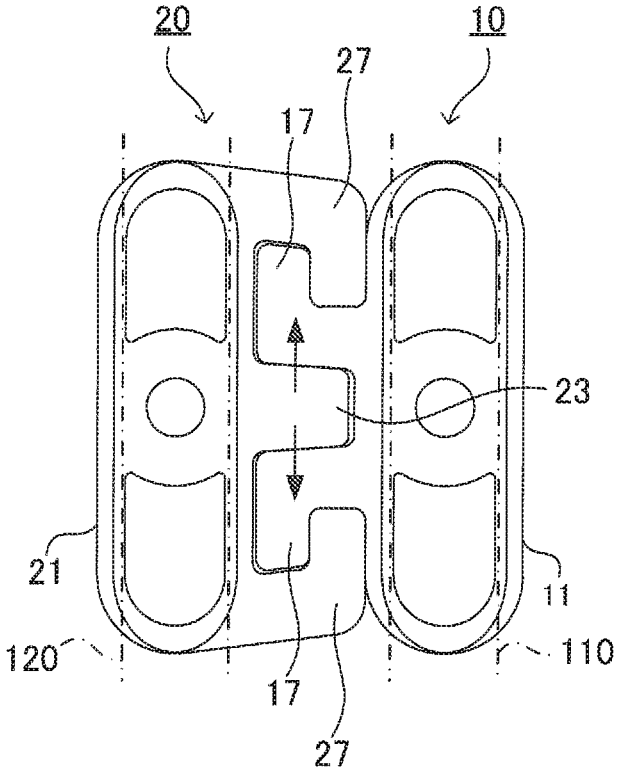
FIG. 4 is a top view showing that the convex linking member and the concave linking member according to the first embodiment are engaged.

In the linking mechanism 1 described above, the convex linking member 10 provided on the chair 100 on one hand and the concave linking member 20 provided on the chair 100 on the other hand can be engaged with each other, by overlapping the regions projecting from the side regions of the chairs 100 respectively, and by relatively displacing one linking member toward the other linking member in the up and down direction. At this time, as shown in FIG. 4, the engaging projection 23 of the concave linking member 20 engages with the notch portion 15 of the convex linking member 10. At the same time, the extending portion 13 and the engaging pieces 17 of the convex linking member 10 are surrounded, for engagement, by the spaces 25 which are formed by the engaging wall portions 27 of the concave linking member 20.

At this time, since the width in the front and back direction of the base side of the engaging projection 23 in the concave linking member 20 is larger than that of the region of the notch portion 15 with which the base side engages, the notch portion 15 is pushed to be widened when the engaging projection 23 is engaged into the notch portion 15 (see arrows in FIG. 4).

(1-2) Operation and Effect

In the linking mechanism according to the above structure, not only the extending portion 13 and the engaging pieces 17 in the convex linking member 10 engage into the spaces 25 surrounded by the engaging wall portions 27 in the concave linking member 20, but also the engaging projection 23 in the concave linking member 20 engages into the notch portion 15 formed in the extending portion 13 of the convex linking member 10. Accordingly, the engaging projection 23 of the concave linking member 20 is located between the two parts of the extending portion 13 in the convex linking member 10 along the front and back direction.

According to this structure, the extending portion 13 in the convex linking member 10 is made difficult to be displaced along the rotational direction together with the engaging pieces 17 within the spaces 25 surrounded by the engaging wall portions 27 in the concave linking member 20, even when the chair 100 is subjected to a force that causes the front or hack end side to be displaced in the up and down direction by, for example, a user who stands up or sits down, or passes through a space in front of or behind the chair 100 to contact the chair 100, causing the chair 100 to make a rotational motion about the opposite side to the end side contacted by the user.

This is because, in the above structure, with respect to the displacement in the rotational direction, not only the extending portion 13 and the engaging pieces 17 in the convex linking member 10 and the inner circumference surfaces of the engaging wall portions 27 in the concave linking member 20 contact each other in the regions of the front and hack ends, but also the inner circumference surface of the notch portion 15 in the convex linking member 10 and the engaging projection 23 of the concave linking member 20 contact each other in the regions of the front and back ends. Thus, since larger frictional resistance can be ensured due to the larger contact area as compared to the conventional structure, the extending portion 13 in the convex linking member 10, together with the engaging pieces 17, is inhibited from being displaced along the rotational direction.

As a result, since the linking members 10 and 20 are made difficult to be disengaged from each other, a linking mechanism suitable for maintaining a state in which the neighboring chairs 100 are aligned can be realized.

Also, according to the above embodiment, the engaging pieces 17, which project in the direction away from each other in the convex linking member 10, can be engaged into the spaces 25 surrounded by the engaging wall portions 27 which extend in the direction toward the engaging projection 23 in the concave linking member 20 respectively.

Also, in the above embodiment, since the base side of the engaging projection 23 is wider in the front and back direction than the region of the notch portion 15 with which the base side of the engaging projection 23 engages, the notch portion 15 is pushed to be widened when the engaging projection 23 is engaged into the notch portion 15 of the convex linking member 10.

Accordingly, since each of the two parts into which the extending portion 13 is divided can be pushed into the inner circumference surface of the engaging wall portion in the concave linking member 20 while coining into intimate contact with the engaging projection 23, the extending portion 13 and the engaging pieces 17 in the convex linking member 10 and the engaging wall portions 27 in the concave linking member 20 can be satisfactorily contacted to each other in the regions of the front and back ends, while ensuring workability of engaging and disengaging (easiness of attaching and detaching) by providing clearance (a gap).

(1-3) Variations

In the above embodiment, the extending portion 13 and the engaging pieces 17 in the convex linking member 10 and the engaging wall portions 27 in the concave linking member 20 may be any structure as long as the former engages into a space surrounded by the latter, and a concrete extending direction or the like thereof is not limited to the structure according to the above embodiment.

Figure 5A:
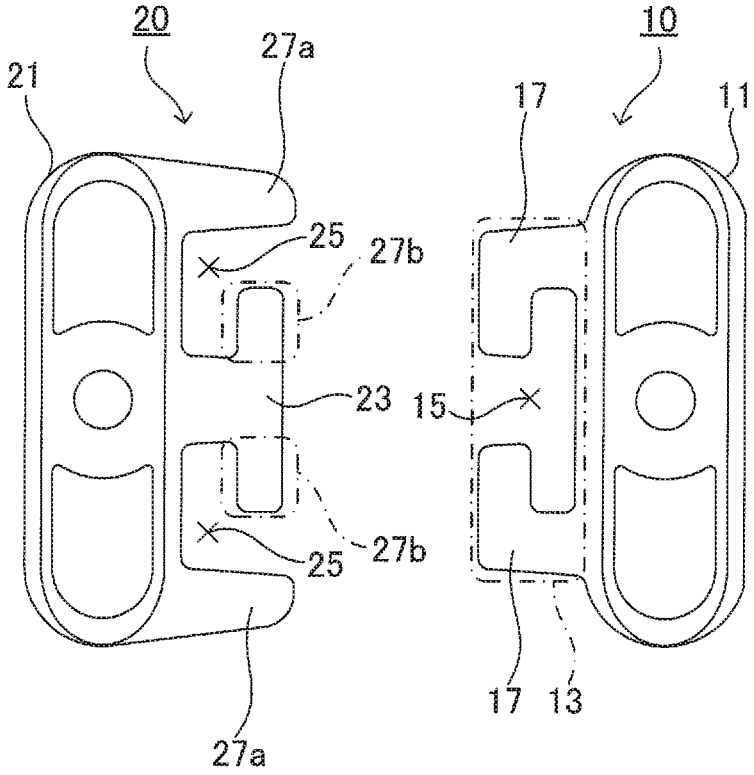
FIGS. 5A and 5B are top views (1) showing the convex linking member and the concave linking member according to the first embodiment.
Figure 5B:
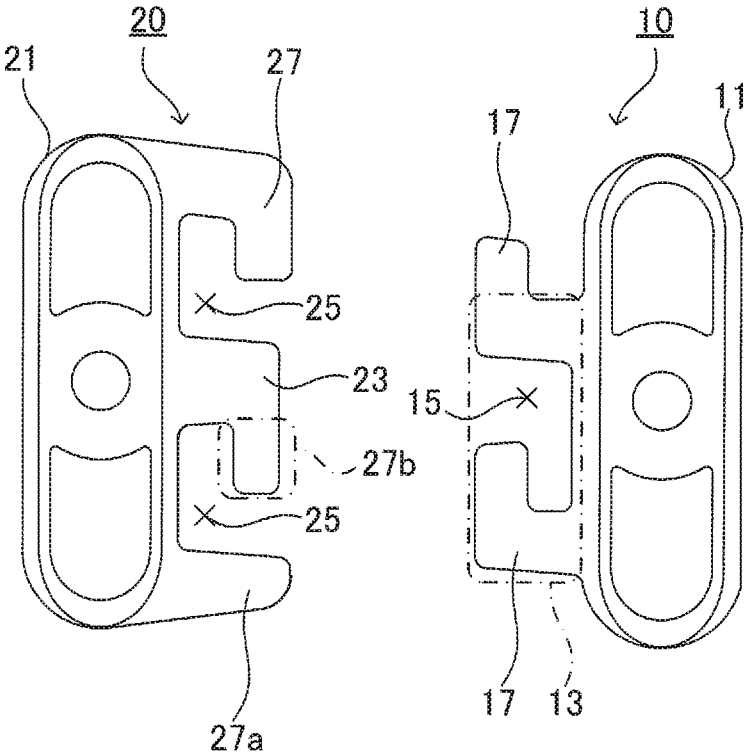

For example, as shown in FIG. 5A, a structure is conceivable in which each of the engaging pieces 17 in the convex linking member 10 is configured to project toward the direction approaching each other, and each of the engaging wall portions 27 is divided into a site 27*a* and a site 27*b*. The site 27*a* extends in the direction away from the concave-side mounting portion 21, and the site 27*b* extends in the direction away from the front end side of the engaging projection 23.

Also, as shown in FIG. 58, a structure is conceivable in which each of the engaging pieces 17 in the convex linking member 10 projects in the same direction along the front and back direction, and the concave linking member 20 includes an engaging wall portion 27 that is similar to the above embodiment and an engaging wall portion 27 that includes the above sites 27*a* and 27*b*.

In the above embodiment, a structure is illustrated in which the base side of the engaging projection 23 in the concave linking member 20 having a larger width allows the extending portion 13 and the engaging pieces 17 in the convex linking member 10 and the engaging wall portions 27 in the concave linking member 20 to satisfactorily contact each other in the regions of the front and back ends. However, in order to obtain satisfactory contact, a concrete structure is not specifically limited, as long as the base side of the engaging projection 23 in the concave linking member 20 is wider in the front and back direction as compared to the region of the notch portion 15 which corresponds to the base side.

For example, a structure is conceivable in which the notch portion 15 in the convex linking member 10 is configured that the width in the front and back direction in the front end region of the extending portion 13 is smaller than that in the region on the convex-side mounting portion 11 side.

In such a structure, since the notch portion 15 in the convex linking member 10 becomes narrower in the front end region of the extending portion 13, when the engaging projection 23 of the concave linking member 20 engages into the notch portion 15, the notch portion 15 is pushed to be widened by the engaging projection 23. Accordingly, each of the two parts into which the extending portion 13 is divided is pushed against the inner circumference surface of the engaging wall portion 27 in the concave linking member 20 while corning into intimate contact with the engaging projection 23. Therefore, the extending portion 13 and the engaging pieces 17 in the convex linking member 10 and the engaging wall portions 27 in the concave linking member 20 can be satisfactorily contacted to each other in the regions of the front and back ends.

Figure 6A:
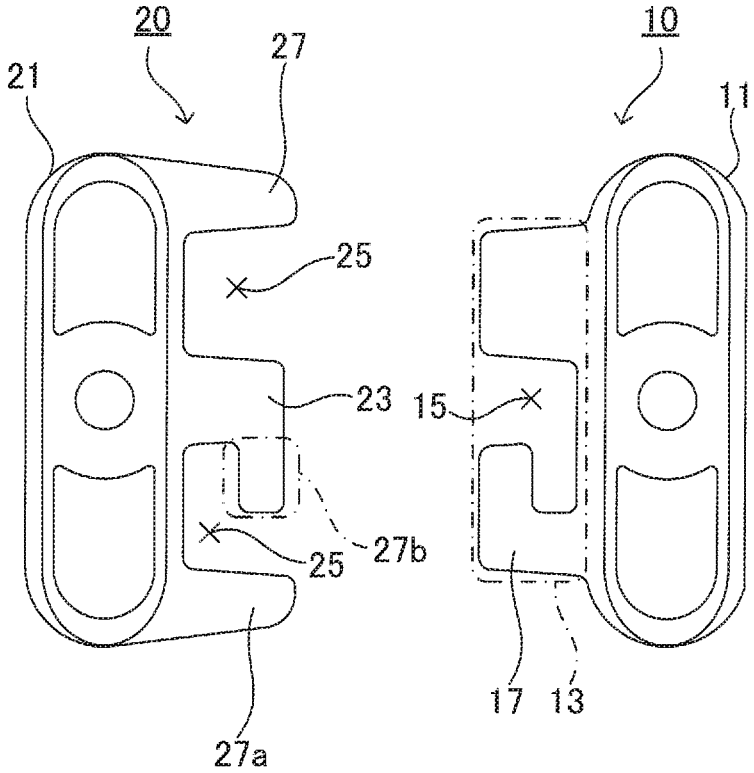
FIGS. 6A and 6B are top views (2) showing the convex linking member and the concave linking member according to the first embodiment.
Figure 6B:
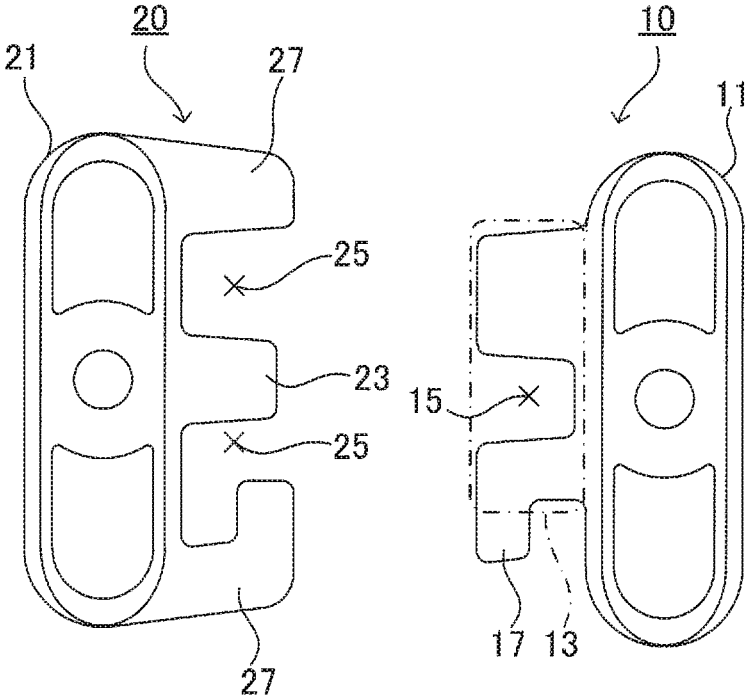

Also, in the above embodiment, the engaging pieces 17 in the convex linking member 10 are configured as a pair which respectively project toward the notch portion 15 from the front end sides of the two parts into which the extending portion 13 is divided. However, the engaging pieces 17 may be configured, as shown in FIG. 6A and FIG. 6B, so as to project only from the front end side of one of the two parts into which the extending portion 13 is divided. In this case, the engaging wall portion 27 in the concave linking member 20, which surrounds one of the two parts of the extending portion 13 without the engaging piece 17, may be formed as a wall which surrounds only the one of the two parts of the extending portion 13.

Figure 7A:
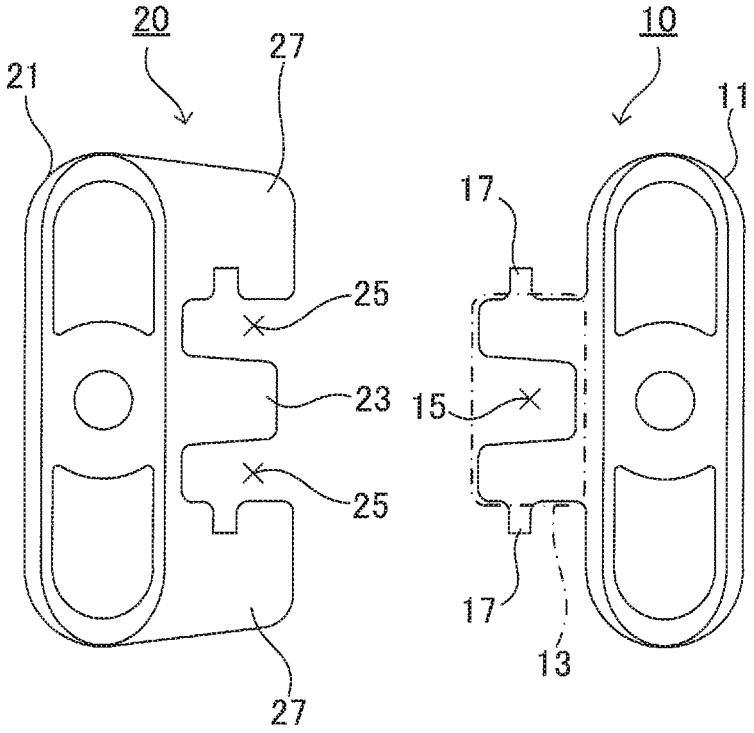
FIGS. 7A and 7B are top views (3) showing the convex linking member and the concave linking member according to the first embodiment.
Figure 7B:
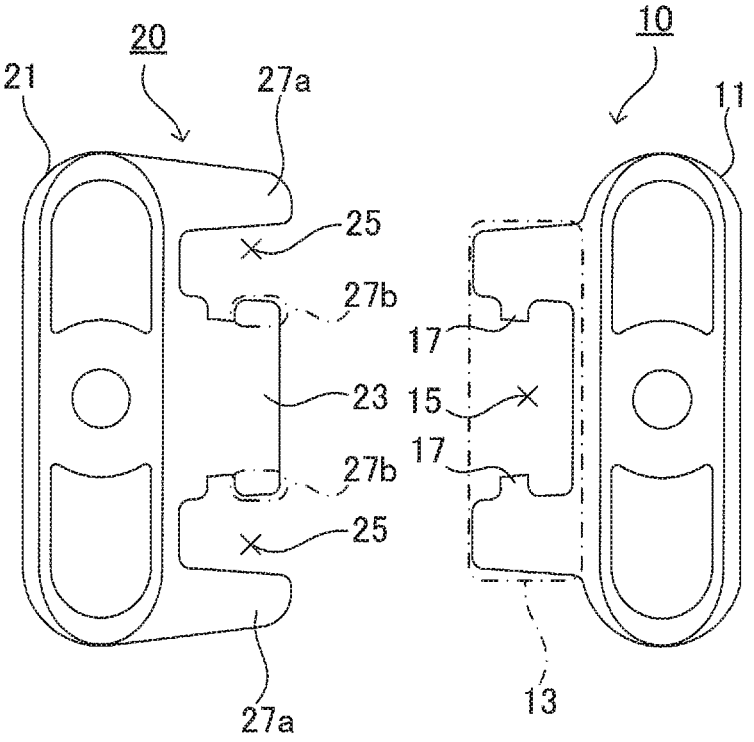

Also, in the above embodiment, it is configured that the pair of engaging pieces 17 project from the front ends of the two parts of the extending portion 13 respectively. However, the engaging pieces 17 may be configured, as shown in FIG. 7A and FIG. 7B, to project from the position closer to the base side than the front end of the extending portion 13.

(2) Second Embodiment (2-1) Entire Structure

Figure 8A:
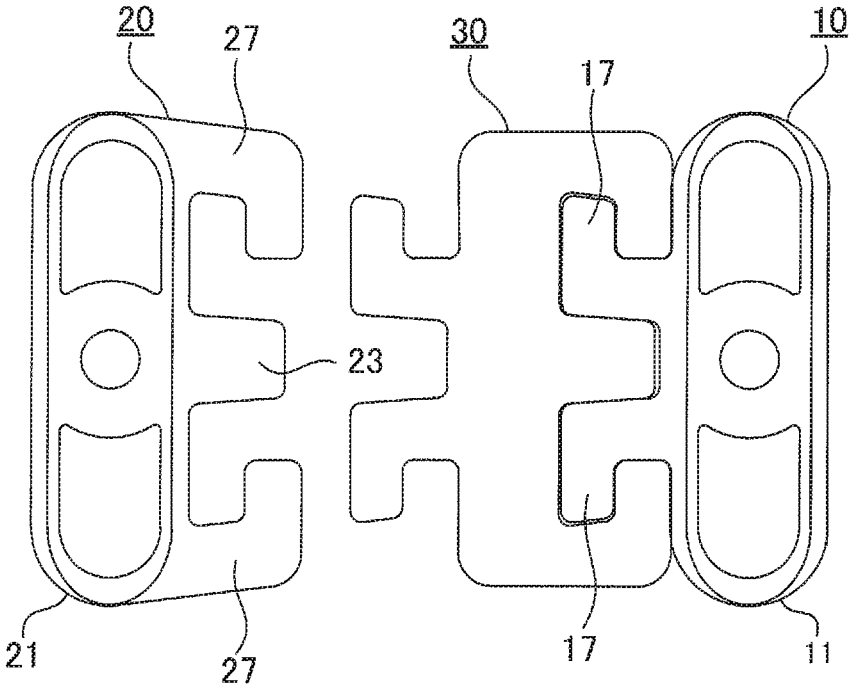
FIGS. 8A and 8B are a top view (1) showing the convex linking member and the concave linking member according to the second embodiment and a top view showing the convex-side extension member.

In the present embodiment, it is configured, as shown in FIG. 8A, that a convex-side extension member 30 is removably fixed to the convex linking member 10.

Figure 8B:
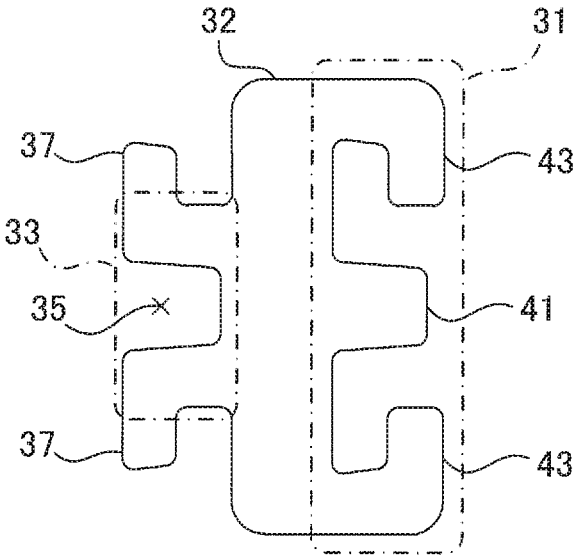

The convex-side extension member 30 includes, as shown in FIG. 8B, a convex-side fixing portion 31 which is removably fixed to the convex linking member 10; a convex-side extension portion 32 which is formed by extending the convex-side fixing portion 31 in the direction toward the chair 100 on the other hand; an extension extending portion 33 which extends from an end region (an end region in the direction toward the chair 100 on the other hand) of the convex-side extension portion 32 toward the chair 100 on the other hand; an extension notch portion 35 which is formed by notching the region reaching from a front end region of the extension extending portion 33 to the convex-side extension portion 32 side; and an extension engaging piece 37 which projects along the front and back direction from one or both of the front end sides of two parts into which the extension extending portion 33 is divided by the extension notch portion 35.

The extension notch portion 35 according to the present embodiment divides the extension extending portion 33 into two parts in the front and back direction, and is formed as a notch capable of engaging with the engaging projection 23 of the concave linking member 20. Also, the extension engaging piece 37 is formed as an engaging piece which is surrounded by the engaging wall portion 27 of the concave linking member 20, together with the extension extending portion 33.

The convex-side fixing portion 31 has sites 41 and 43 which function as the engaging projection 23 and the pair of engaging wall portions 27 in the concave linking member 20. The sites 41 and 43 are engaged with the extending portion 13, the notch portion 15 and the engaging pieces 17 in the convex linking member 10 respectively, so that the convex-side extension member 30 and the convex linking member 10 are fixed.

(2-2) Operation and Effect

According to the linking mechanism 1 configured as above, when the convex-side extension member 30 is fixed to the convex linking member 10, the extension extending portion 33, the extension notch portion 35 and the extension engaging piece 37 in the convex-side extension member 30 function as the extending portion 13, the notch portion 15 and the engaging piece 17 in the convex linking member 10. Therefore, even in this state, linkage with the concave linking member 20 can be realized.

Here, since the convex-side extension member 30 which is fixed to the convex linking member 10 is formed by further extending the convex linking member 10 toward the chair 100 on the other hand, the distance between the neighboring chairs 100 can be adjusted in accordance with the extended length of the convex-side extension portion 32, depending on whether the convex-side extension member 30 is fixed to or removed from the convex linking member 10.

Also, the sites 41 and 43, which the convex-side fixing portion 31 in the convex-side extension member 30 has, function as the concave-side mounting portion 21, the engaging projection 23 and the pair of engaging wall portions 27 in the concave linking member 20. Therefore, fixing of the convex-side extension member 30 and the convex linking member 10 can be realized by engaging the sites 41 and 43 with the convex linking member 10.

(2-3) Variations

In the above embodiment, the sites 41 and 43 of the convex-side fixing portion 31 in the convex-side extension member 30 are configured to engage with the convex linking member 10 side so that the convex-side extension member 30 and the convex linking member 10 are fixed. However, fixing of the both may be realized by a structure other than this structure.

Figure 9A:
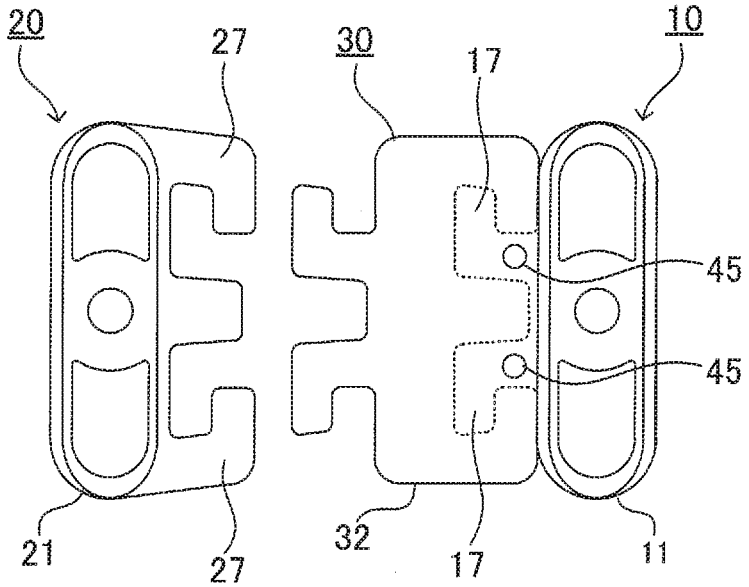
FIGS. 9A and 9B are top views (2) showing the convex linking member and the concave linking member according to the second embodiment.

For example, as shown in FIG. 9A, a structure is conceivable in which the convex-side extension member 30 and the convex linking member 10 are fixed by fixing to the extending portion 13 in the convex linking member 10 using a screw 45 or the like.

According to this structure, fixing of the convex-side extension member 30 and the convex linking member 10 can be realized by screwing.

Figure 9B:
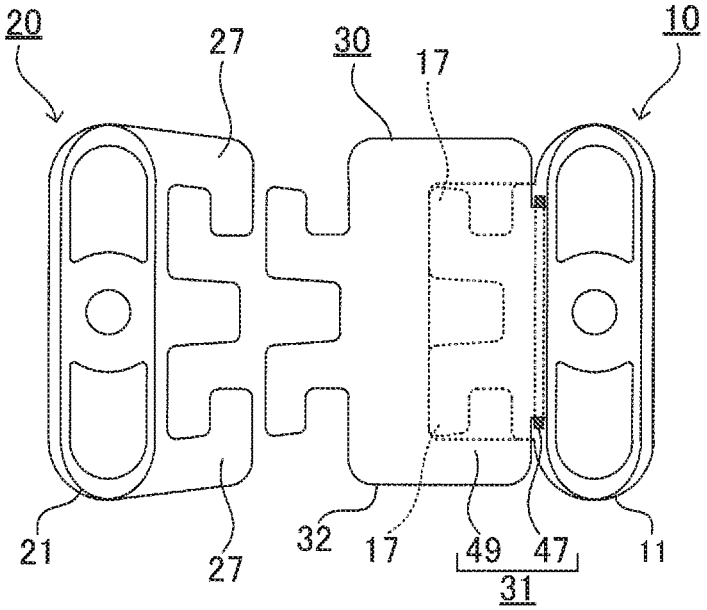

Also, as shown in FIG. 9B, a structure is conceivable in which the convex-side fixing portion 31 is configured to include a rotational mounting portion 47 and a surrounding positioning portion 49. The rotational mounting portion 47 is mounted to the convex linking member 10 in a position where the convex-side extension member 30 as a whole rotates about an axis extending in the front and back direction. The surrounding positioning portion 49 positions the convex-side extension member 30 by surrounding the extending portion 13 and the engaging piece 17 when the extending direction of the convex-side extension portion 32 runs along the direction toward the chair 100 on the other hand.

Here, the rotational mounting portion 47 is a shaft body provided along the convex-side mounting portion 11. The surrounding positioning portion 49 is shaped so as to surround the extending portion 13 and the engaging piece 17 for engagement.

According to this structure, a state, in which the convex-side extension member 30 is engaged with the convex linking member 10, can be realized by rotating the convex-side extension member 30 about the convex-side fixing portion 31 so that the extending direction of the convex-side extension portion 32 runs along the direction toward the chair 100 on the other hand. Furthermore, a state, in which the convex-side extension member 30 is removed from the convex linking member 10, can be realized by rotating the convex-side extension member 30 so that the extending direction of the convex-side extension portion 32 runs along the up and down direction.

(3) Third Embodiment (3-1) Entire Structure

Figure 10A:
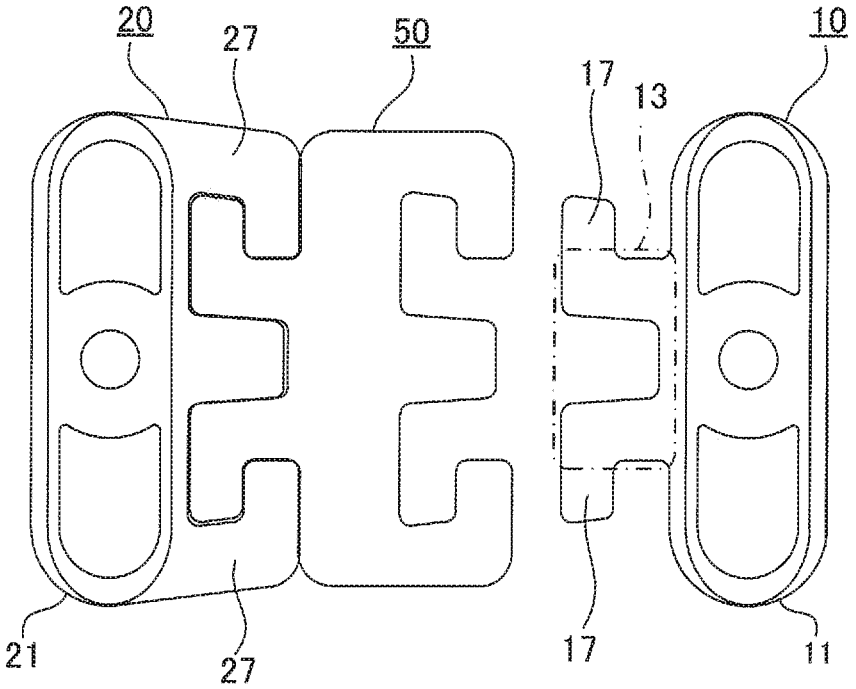
FIGS. 10A and 10B are a top view (1) showing the convex linking member and the concave linking member according to the third embodiment, and a top view showing the concave-side extension member.

In the present embodiment, it is configured, as shown in FIG. 10A, that a concave-side extension member 50 is removably fixed to the concave linking member 20.

Figure 10B:
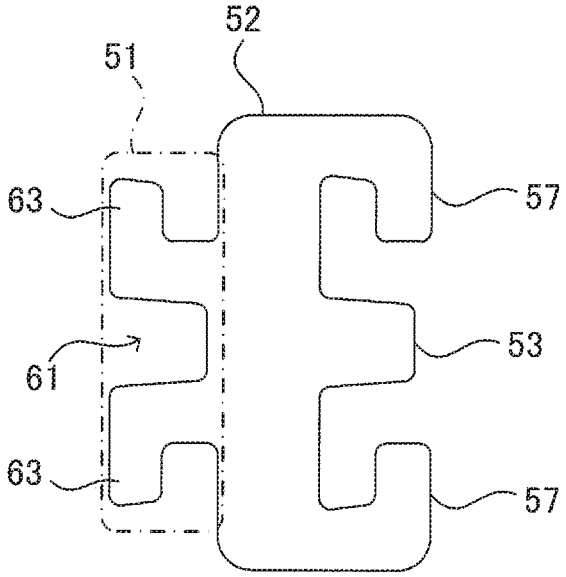

The concave-side extension member 50 includes, as shown in FIG. 10B, a concave-side fixing portion 51 which is removably fixed to the concave linking member 20; a concave-side extension portion 52 which is formed by extending the concave-side fixing portion 51 in the direction toward the chair 100 on one hand to engage into the notch portion 15 in the convex linking member 10; an extension engaging projection 53 which projects in the direction from the concave-side extension portion 52 toward the chair 100 on one hand to engage into the notch portion 15 in the convex linking member 10; and a pair of extension engaging wall portions 57 between which the extension engaging projection 53 is located and which extend along the direction from the concave-side fixing portion 51 toward the chair 100 on one hand and along the direction toward one of the front and back sides respectively.

The extension engaging wall portions 57 according to the present embodiment extend in the direction away from the concave-side fixing portion 51 and then in the direction toward the extension engaging projection 53 respectively. Accordingly, each of the extension engaging wall portions 57 functions as a wall which surrounds one of the two parts into which, the extending portion 13 is divided and the engaging piece 17 in the surrounded part of the extending portion 13 in the convex linking member 10.

Also, the concave-side fixing portion 51 has sites 61 and 63 which function as the extending portion 13, the notch portion 15 and the engaging piece 17 in the convex linking member 10. The sites 61 and 63 are engaged with the engaging projection 23 and the pair of engaging wall portions 27 in the concave linking member 20 respectively so that the concave-side extension member 50 and the concave linking member 20 are fixed.

(3-2) Operation and Effect

According to the linking mechanism 1 configured as above, when the concave-side extension member 50 is fixed to the concave linking member 20, the extension engaging projection 53 and the pair of extension engaging wall portions 57 in the concave-side extension member 50 function as the engaging projection 23 and the pair of engaging wall portions 27 in the concave linking member 20. Therefore, even in this state, linkage with the convex linking member 10 can be realized.

Here, since the concave-side extension member 50 fixed to the concave linking member 20 is configured by further extending the concave linking member 20 toward the chair 100 on one hand, the distance between the neighboring chairs 100 can be adjusted in accordance with the extended length of the concave-side extension portion 52, depending on whether the concave-side extension member 50 is fixed to or removed from the concave linking member 20.

Also, the sites 61 and 63, which the concave-side fixing portion 51 in the concave-side extension member 50 has, function as the extending portion 13, the notch portion 15 and the engaging piece 17 in the convex linking member 10. Therefore, fixing of the concave-side extension member 50 and the concave linking member 20 can be realized by engaging the sites 61 and 63 with the concave linking member 20.

(3-3) Variations

In the above embodiment, it is configured that the concave-side extension member 50 and the concave linking member 20 are fixed together by engaging the sites 61 and 63 of the concave-side fixing portion 51 in the concave-side extension member 50, with the concave linking member 20. However, fixing of the both may be realized by a structure other than this structure.

Figure 11A:
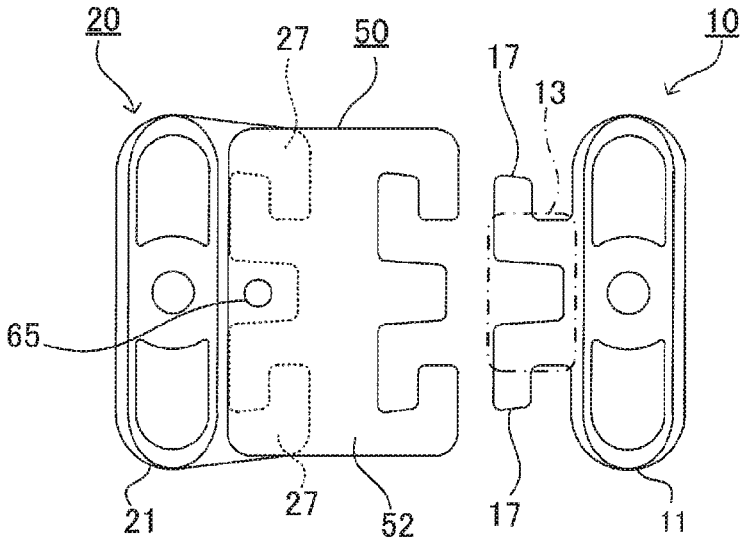
FIGS. 11A to 11C are top views (2) showing the convex linking member and the concave linking member according to the third embodiment.

For example, as shown in FIG. 11A, a structure is conceivable in which the concave-side extension member 50 and the concave linking member 20 are fixed together by fixing the concave-side extension member 50 to the engaging projection 23 or the engaging wall portions 27 in the concave linking member 20 using a screw 65 or the like.

According to this structure, fixing of the concave-side extension member 50 and the concave linking member 20 can be realized by screwing.

Figure 11B:
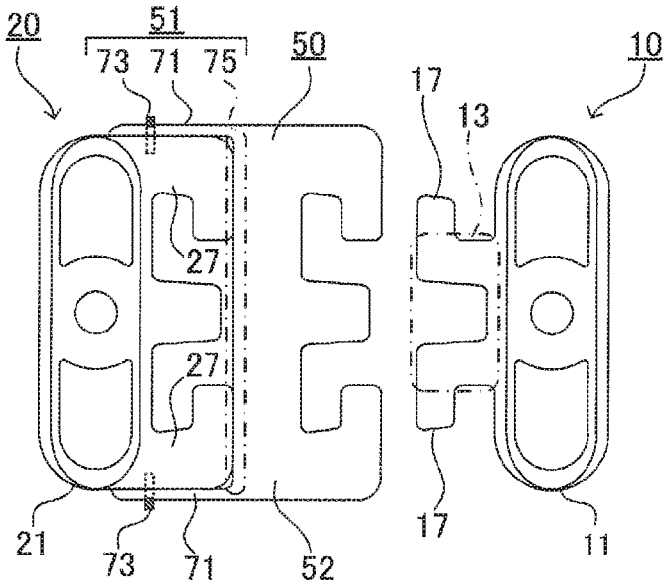
Figure 11C:
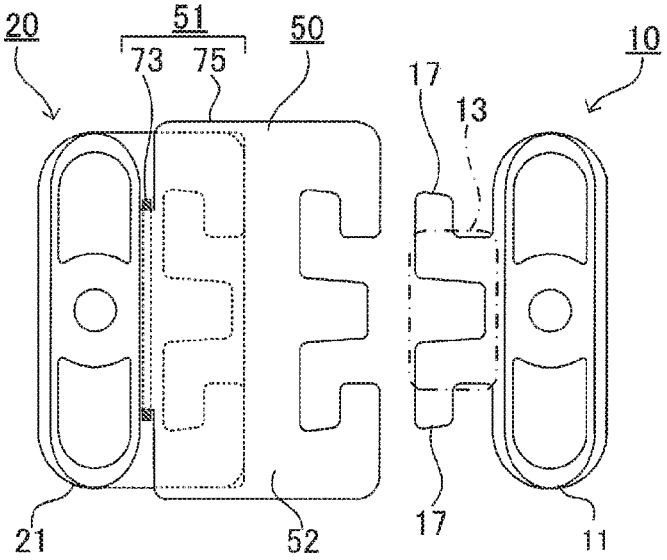

Also, as shown in FIG. 11B and FIG. 11C, a structure is conceivable in which the concave-side fixing portion 51 includes a rotational mounting portion 73 and a surrounding positioning portion 75. The rotational mounting portion 73 is fixed to the convex linking member 10 in a position where the convex-side extension member 50 as a whole rotates about the axis extending in the front and back direction. The surrounding positioning portion 75 surrounds the engaging wall portions 27 to position the concave-side extension member 50 when the extending direction of the convex-side extension portion 52 runs along the direction toward the chair 100 on one hand.

Here, the rotational mounting portion 73 may be, as shown in FIG. 11B, a shaft body which reaches from each of a pair of plate-like portions 71 to the engaging wall portions 27 in the concave linking member 20. The engaging wall portions 27 in the concave linking member 20 are located between the pair of plate-like portions 71 in the front and back direction. Alternatively, as shown in FIG. 11C, the rotational mounting portion 73 may be a shaft body which is provided along the concave-side mounting portion 21.

According to this structure, a state in which the concave-side extension member 50 is mounted to the concave linking member 20 can be realized, by rotating the concave-side extension member 50 about the concave-side fixing portion 51 so that the extending direction of the concave-side extension portion 52 runs along the direction toward the chair 100 on one hand. Furthermore, a state in which the concave-side extension member 50 is removed from the concave linking member 20 can be realized by rotating the concave-side extension member 50 so that the extending direction of the concave-side extension portion 52 runs along the up and down direction.

(4) Other Variations

Although the embodiments of the present invention have been described above, it is not to say that the present invention is not limited to the above embodiments, and various forms are possible within the technical scope of the present invention.

For example, in the above embodiments, it has been illustrated that the convex linking member 10 is provided below the right leg body 110 that is the right side region, and the concave linking member 20 is provided below the left leg body 120 that is the left side region. However, the convex linking member 10 and the concave linking member 20 may be provided in a certain position in the up and down direction, such as the upper end sides of the right leg body 110 and the left leg body 120, other than the regions below the right leg body 110 and the left leg body 120, as long as the linking members are provided in each of the side regions of the chair 100.

Figure 12A:
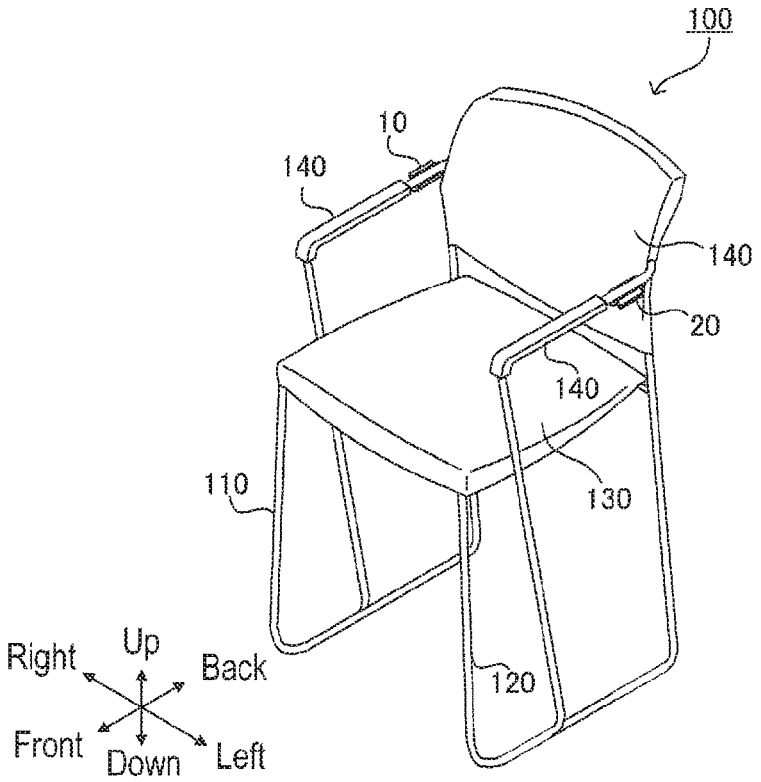
FIGS. 12A and 12B are a perspective view showing the chair according to another embodiment, and a top view showing that the convex linking member and the concave linking member are engaged.
Figure 12B:
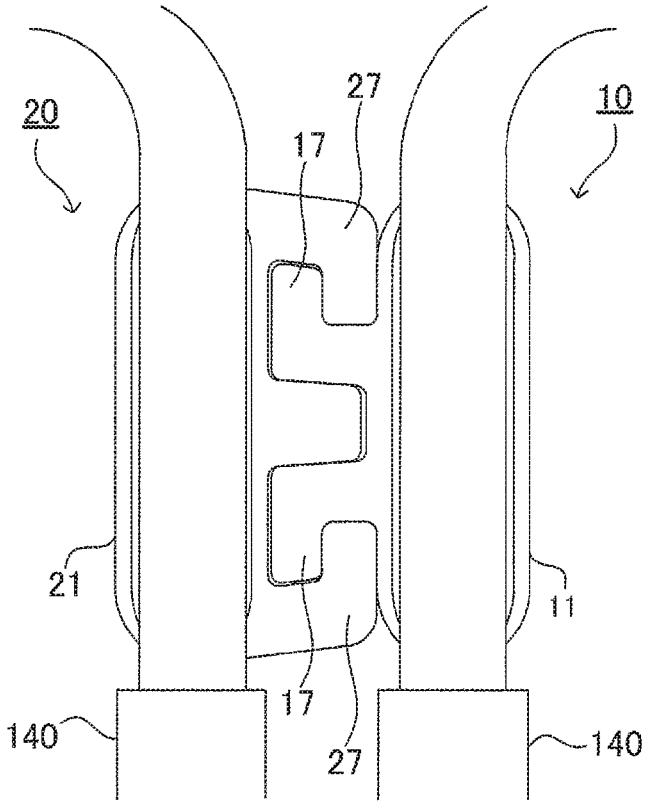

Also, as shown in FIG. 12A, when an armrest 140 is provided laterally to the chair 100, a structure is conceivable in which the armrest 140 is provided with the convex linking member 10 and the concave linking member 20. In this case, as shown in FIG. 12B, each of the neighboring chairs 100 is linked by the convex linking member 10 and the concave linking member 20 which are provided to each armrest 140.

Figure 13:
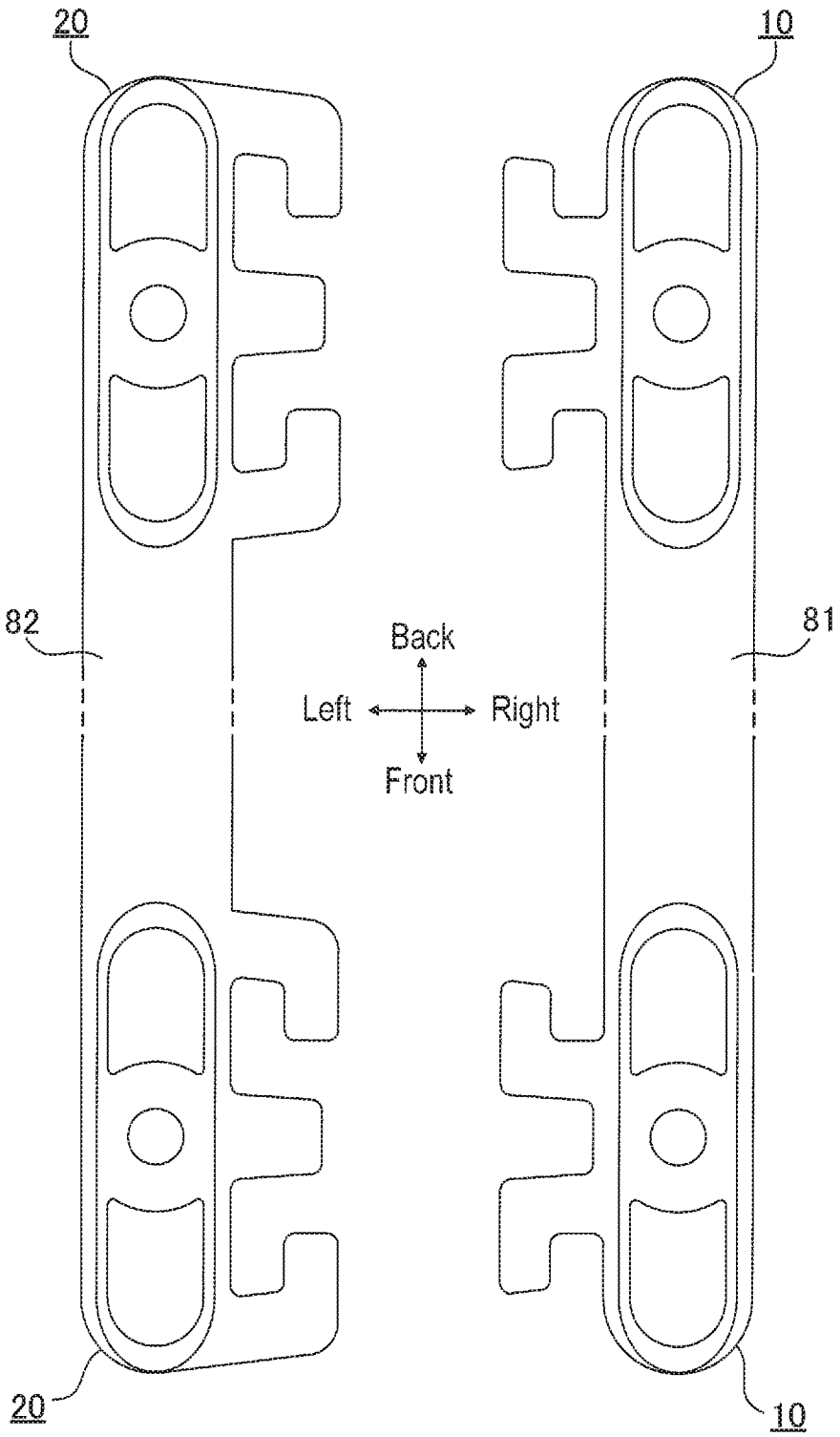
FIG. 13 is a top view showing the convex linking member and the concave linking member according to another embodiment.

Also, a structure, in which the convex linking member 10 and the concave linking member 20 are independently provided in each of the front and back sides, is illustrated in the above embodiments. However, as shown in FIG. 13, the linking members 10 and 20 on the front side and the linking members 10 and 20 on the back side may be connected to each other respectively by connecting members 81 and 82 which reach from the front side to the back side, thereby to constitute an integrated component.

According to this structure, since the distance between the front side and the back side can be uniquely determined by the connecting members 81 and 82, positioning can be adjusted more easily during the work of mounting the linking members 10 and 20 to the chair 100.

Figure 14A:
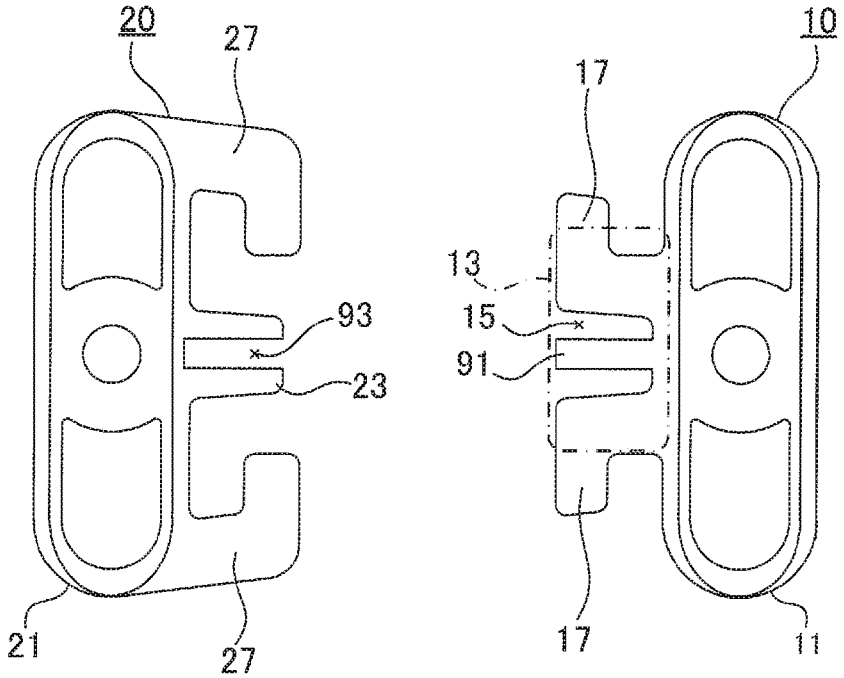
FIGS. 14A to 14C are top views showing the convex linking member and the concave linking member according to another embodiment.

Also, in the above embodiments, as shown in FIG. 14A, a notch portion projection 91 may be formed to the convex-side mounting portion 11 in the convex linking member 10, and a projection portion notch 93 may be formed to the engaging projection 23 in the concave linking member 20. The notch portion projection 91 projects from the region where the notch portion 15 is formed, to the direction toward the chair 100 on the other hand. The projection portion notch 93 notches the projection 23 from the front end toward the concave-side mounting portion 21, and engages with the notch portion projection 91 in the convex linking member 10.

Figure 14B:
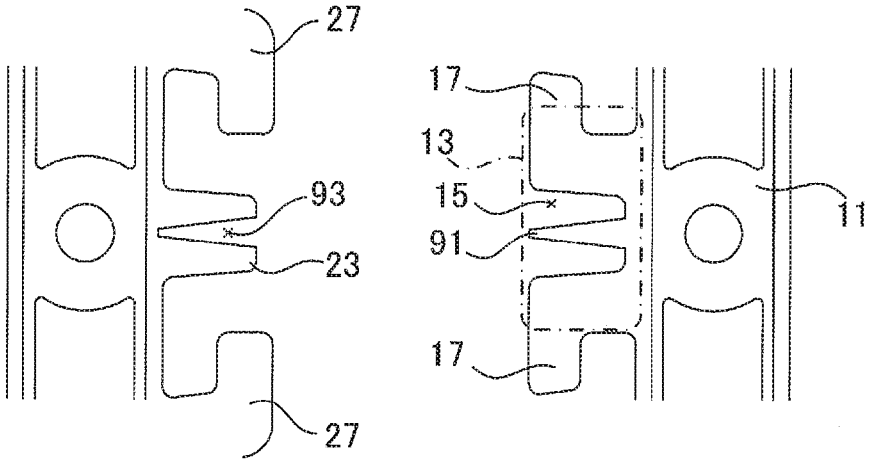
Figure 14C:
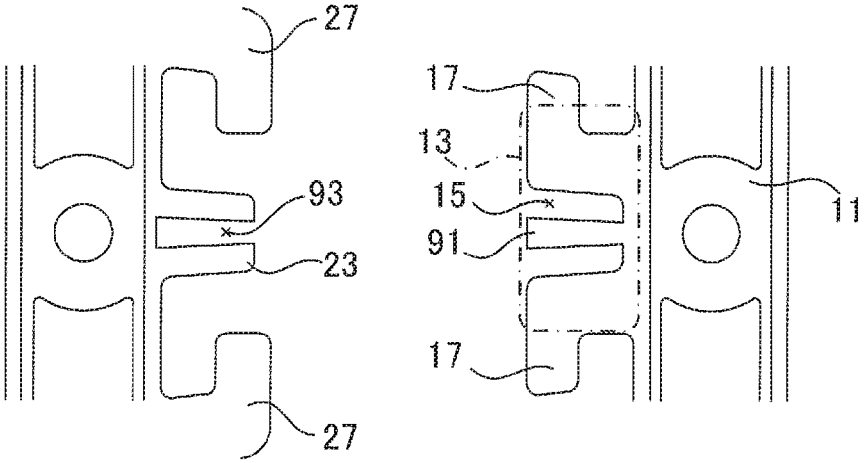

In this structure, as shown in FIG. 14B, the width of the notch portion projection 91 in the convex linking member 10 decreases (or increases as shown in FIG. 14C) toward the direction away from the convex-side mounting portion 11. On the other hand, the width of the projection portion notch 93 in the concave linking member 20 increases (or decreases as shown in FIG. 14C) toward the direction away from the convex-side mounting portion 11. Thus, the contact area in the regions of the front and hack ends can be suitably increased.

According to this structure, with respect to the displacement in the rotational direction, the extending portion 13 of the convex linking member 10 and the inner circumference surfaces of the engaging wall portions 27 in the concave linking member 20, and the inner circumference surfaces of the notch portion 15 in the convex linking member 10 and the engaging projection 23 of the concave linking member 20 contact each other respectively in the regions of the front and back ends. In addition, the notch portion projection 91 of the convex linking member 10 and the projection portion notch 93 of the concave linking member 20 contact each other in the regions of the front and back ends. Accordingly, with respect to the displacement in the rotational direction, each of the linking members can be more effectively inhibited from being displaced.

The invention claimed is:

1. A linking mechanism for linking a plurality of chairs; the plurality of chairs being aligned in a left and right direction; the linking mechanism comprising a portion configured to receive at least a part of a leg of a chair; a surface configured to abut a floor surface, and configured to support the chair on the floor surface, and a convex linking member and a concave linking member, the convex linking member and the concave linking member being engaged with each other thereby to realize linkage of the plurality of chairs, wherein the convex linking member includes:

a convex-side mounting portion which is provided to one of left and right side regions in a first chair of the plurality of chairs;

an extending portion which extends in a direction from the convex-side mounting portion toward a second chair of the plurality of chairs;

a notch portion which notches a region reaching from a front end region of the extending portion to a side of the convex-side mounting portion, thereby to divide the extending portion into two parts in a front and back direction; and an engaging piece which projects along the front and back direction from one or both of front end sides of the two parts into which the extending portion is divided by the notch portion, and wherein the concave linking member includes:

a concave-side mounting portion which is provided to the other of the left and right side regions of the second chair of the plurality of chairs;

an engaging projection which projects from the concave-side mounting portion to a direction toward the first chair of the plurality of chairs and engages into the notch portion in the convex linking member; and a pair of engaging wall portions between which the engaging projection is located, and each of which function as a wall that surrounds one of the two parts into which the extending portion is divided and the engaging piece in the surrounded part of the extending portion in the convex linking member.

2. The linking mechanism according to claim 1, wherein the engaging piece in the convex linking member extends along the front and back direction from each of the front end sides of the two parts into which the extending portion is divided by the notch portion, and each of the pair of the engaging wall portions in the concave linking member, between which the engaging projection is located, includes: a site which extends from the concave-side mounting portion to the first chair of the plurality of chairs; and a site which extends toward one of front and back directions, and the each engaging wall portion functions as a wall that surrounds one of the two parts of the extending portion and the engaging piece in the surrounded part of the extending portion in the convex linking member, between the concave-side mounting portion and the engaging projection.

3. The linking mechanism according to claim 2, wherein the engaging pieces in the convex linking member project from the front end sides of the two parts into which the extending portion is divided, toward the direction away from each other respectively, and the pair of engaging wall portions in the concave linking member, between which the engaging projection is located, extend from the concave-side mounting portion toward the first chair of the plurality of chairs and toward the engaging projection.

4. The linking mechanism according to claim 1, wherein an end side opposite to a front end of the engaging projection in the concave linking member has a width in the front and back direction which is relatively larger than a region of the notch portion with which the end side opposite to a front end of the engaging projection engages.

5. The linking mechanism according to claim 4, wherein the notch portion in the convex linking member is formed by notching a region thereof so that a width in the front and back direction is smaller in a region of the front end of the extending portion than in a region on a side of the convex-side mounting portion.

6. The linking mechanism according to claim 4, wherein the engaging projection in the concave linking member is formed such that a width in the front and back direction is larger on the end side opposite to a front end than on a side of the front end.

7. The linking mechanism according to claim 1, wherein the convex linking member includes at least a front-side convex linking member which realizes linkage with the chair on the other hand in a front side of the chair, and a back-side convex linking member which realizes linkage with the chair on the other hand on a back side of the chair, the concave linking member includes at least a front-side concave linking member which realizes linkage with the chair on one hand on the front side of the chair, and a back-side concave linking member which realizes linkage with the chair on one hand on the back side of the chair, and a connecting member is provided between the front-side convex linking member and the back-side convex linking member, and/or between the front-side concave linking member and the back-side concave linking member, to connect the front side and the back side.

8. The linking mechanism according to claim 1, comprising:

a notch portion projection which is formed to the convex-side mounting portion in the convex linking member, and projects from a region where the notch portion is formed, to the direction toward the chair on the other hand; and a projection portion notch which is formed to the engaging projection in the concave linking member, notches the engaging projection from the front end thereof toward the concave-side mounting portion and engages with the notch portion projection in the convex linking member.

9. The linking mechanism according to claim 1, comprising a convex-side extension member as described later which is removably fixed to the convex linking member, the convex-side extension member comprising:

a convex-side fixing portion which is removably fixed to the convex linking member;

a convex-side extension portion which is formed by extending the convex-side fixing portion to an end in a direction toward the chair on the other hand;

an extension extending portion which extends from a region of the end in a direction toward the chair on the other hand in the convex-side extension portion, to the direction toward the chair on the other hand;

an extension notch portion, which divides the extension extending portion into two parts in the front and back direction by notching a region reaching from a front end region of the extension extending portion to a side of the convex-side extension portion, and which is formed as a notch capable of engaging with the engaging projection in the concave linking member; and an extension engaging piece, which projects along the front and back direction from one or both of front ends of the two parts into which the extension extending portion is divided by the extension notch portion, and which is formed as an engaging piece to be surrounded by the engaging wall portion of the concave linking member, together with the extension extending portion, for engagement.

10. The linking mechanism according to claim 9, wherein in the convex-side extension member, the convex-side fixing portion has sites which function as the engaging projection and the pair of engaging wall portions in the concave linking member, and the sites are engaged with the extending portion, the notch portion and the engaging piece in the convex linking member so that the convex-side extension member and the convex linking member are fixed.

11. The linking mechanism according to claim 9, wherein in the convex-side extension member, the convex-side fixing portion is configured to be screwed to the extending portion in the convex linking member so that the convex-side extension member and the convex linking member are fixed.

12. The linking mechanism according to claim 9, wherein in the convex-side extension member, the convex-side fixing portion comprises:

a rotational mounting portion which is mounted to the convex linking member in a position where the convex-side extension member as a whole is rotated about an axis that extends in the front and back direction; and a surrounding positioning portion which surrounds the extending portion and the engaging piece thereby to position the convex-side extension member when an extending direction of the convex-side extension portion runs along the direction toward the chair on the other hand.

13. The linking mechanism according to claim 1, comprising a concave-side extension member as described later which is removably fixed to the concave linking member, the concave-side extension member comprising:

a concave-side fixing portion which is removably fixed to the concave linking member;

a concave-side extension portion which is formed by extending the concave-side fixing portion to the direction toward the chair on one hand;

an extension engaging projection which projects from the concave-side extension portion to the direction toward the chair on one hand, and engages with the notch portion in the convex linking member; and a pair of extension engaging wall portions, between which the extension engaging projection is located, and each of which becomes a wall that surrounds one of the two parts into which the extending portion is divided and the engaging piece in the surrounded part of the extending portion in the convex linking member.

14. The linking mechanism according to claim 13, wherein in the concave-side extension member, the concave-side fixing portion has sites which function as the extending portion, the notch portion and the engaging portion in the convex linking member, and the sites are engaged with the engaging projection and the pair of engaging wall portions in the concave linking member respectively so that the concave-side extension member and the concave linking member are fixed.

15. The linking mechanism according to claim 13, wherein in the concave-side extension member, the concave-side fixing portion is configured to be screwed to the engaging projection or the engaging wall portions in the concave linking member so that the concave-side extension member and the concave linking member are fixed.

16. The linking mechanism according to claim 13, wherein in the concave-side extension member, the concave-side fixing portion comprises:

a rotational mounting portion which is fixed to the concave linking member in a position where the concave-side extension member as a whole rotates about an axis that extends in the front and back direction; and a surrounding positioning portion which surrounds the engaging wall portion to position the concave-side extension member when an extending direction of the concave-side extension portion runs along the direction toward the chair on one hand.

17. A chair which is provided with a linking member which comprises a convex linking member and a concave linking member, wherein the convex linking member includes:

a convex-side mounting portion which is provided to one of left and right side regions in a chair on one hand;

an extending portion which extends in a direction from the convex-side mounting portion toward a chair on the other hand;

a notch portion which notches a region reaching from a front end region of the extending portion to a side of the convex-side mounting portion, thereby to divide the extending portion into two parts in a front and back direction; and an engaging piece which projects along the front and back direction from one or both of front end sides of the two parts into which the extending portion is divided by the notch portion, and wherein the concave linking member includes:

a concave-side mounting portion which is provided to the other of the left and right side regions of the chair on the other hand;

an engaging projection which projects from the concave-side mounting portion to a direction toward the chair on one hand and engages into the notch portion in the convex linking member; and a pair of engaging wall portions between which the engaging projection is located, and each of which function as a wall that surrounds one of the two parts into which the extending portion is divided and the engaging piece in the surrounded part of the extending portion in the convex linking member.

18. The linking mechanism according to claim 1, wherein the engaging projection includes a portion configured to further extend in a direction substantially perpendicular to a projecting direction of the engaging projection.

19. The linking mechanism according to claim 1, wherein a configuration of the engaging projection and a configuration of the notch portion have a mutually complementary relationship.

* * * * *